US005479150A

United States Patent [19]

Schmidt et al.

[11] Patent Number: 5,479,150

[45] Date of Patent: Dec. 26, 1995

[54] BRIDGE FAILURE ALARM

[76] Inventors: Douglas L. Schmidt, 2300 Harvard Way, Apt. 122; Robert A. Schmidt, 6052 Plumas St. #A, both of Reno, Nev. 89509

[21] Appl. No.: 235,892

[22] Filed: May 2, 1994

[51] Int. Cl.[6] ..... G08B 21/00

[52] U.S. Cl. ..... 340/540; 340/533; 200/61.49; 116/215

[58] Field of Search ..... 340/540, 686, 340/652, 533, 568; 250/13, 227.14, 227.15, 227.17; 370/540; 385/13; 200/61.49; 116/215; 367/105, 112, 113

[56] References Cited

U.S. PATENT DOCUMENTS

| | | | |
|---|---|---|---|
| 405,042 | 6/1889 | Long | 14/49 |
| 1,213,062 | 1/1917 | Baty | 340/568 |
| 2,650,560 | 9/1953 | Bear | 340/686 |
| 2,689,341 | 9/1954 | Holst | 340/690 |
| 3,522,790 | 8/1970 | Cambre | 116/215 |
| 4,843,372 | 6/1989 | Savino | 370/540 |
| 4,927,232 | 5/1990 | Griffiths | 385/13 |

*Primary Examiner*—John K. Peng
*Assistant Examiner*—Benjamin C. Lee
*Attorney, Agent, or Firm*—Richard C. Litman

[57] ABSTRACT

A bridge failure alarm system designed to be used with bridges has a plurality of spans across the length of the bridge, activates an alarm whenever the distance between any two adjacent spans is greater than a predetermined safe distance. This is accomplished by providing a conduction path extending from one end of the bridge along a first side of the bridge to the other end of the bridge and then back to the first end of the bridge by a conduction path located on the other side of the bridge. Between every expansion joint located between each adjacent span of the bridge are two jumpers to provide electrical connection across the expansion joints, one jumper located on each side of the bridge proximate to each expansion joint. In this manner, should any one of the expansion joints exceed a predetermined width placing two adjacent spans at a distance greater than the predetermined safe distance, at least one of the jumpers located therebetween will break the conduction path causing the alarm to be activated.

4 Claims, 3 Drawing Sheets

FIG. 4
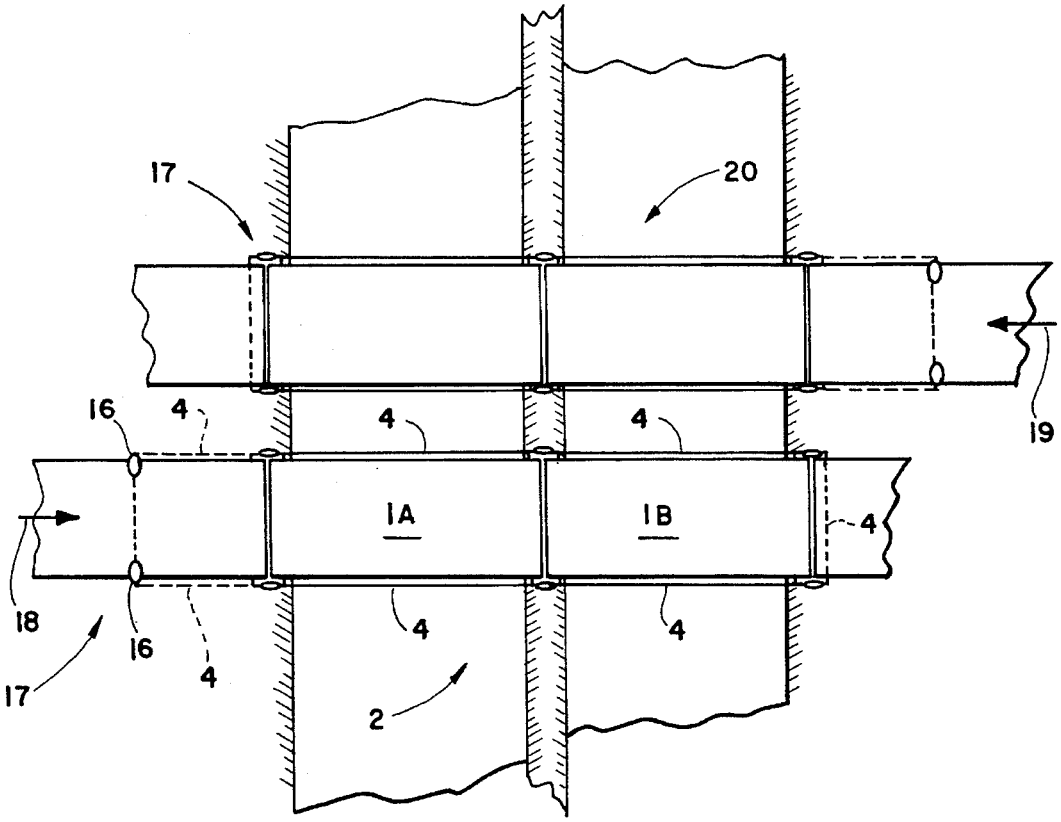
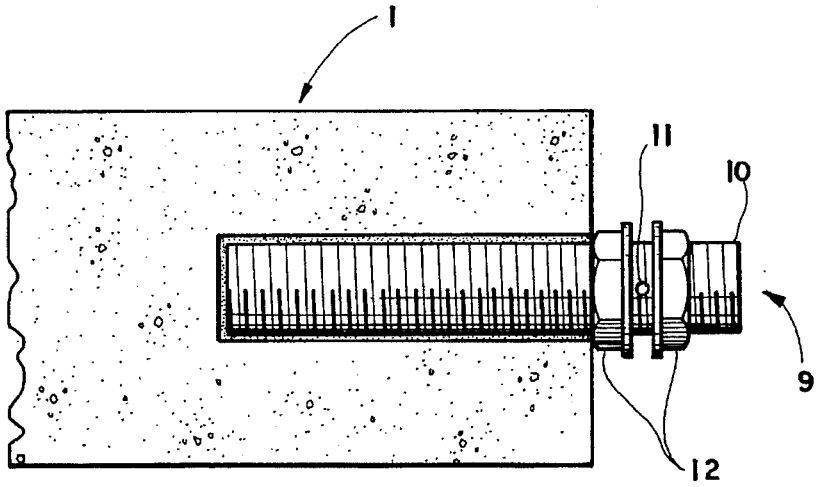
FIG. 2

BRIDGE FAILURE ALARM

BACKGROUND OF THE INVENTION

1. Field of the Invention

The present invention relates to a bridge alarm system for indicating to a user whether or not a bridge utilizing the alarm system is safe to cross over. More specifically, the bridge alarm system of the present invention energizes warning lights at at least one end of the bridge if any expansion joint of the bridge exceeds a predetermined width.

2. Description of the Prior Art

U.S. Pat. No. 405,042 issued Jun. 11, 1889 to Moses H. Long discloses a draw bridge signaling device which automatically displays to anyone approaching the bridge a lamp and/or large disc during whenever the bridge is opened.

U.S. Pat. No. 1,213,062 issued Jan. 16, 1917 to Noah O. Baty discloses a bridge signaling device in which electrical contact jaws and blades located on binding posts beneath a bridge are used to complete an electrical circuit. If the electrical circuit is broken because one of the blades separates from one of the jaws, an alarm sounds.

U.S. Pat. No. 2,650,560 issued Sep. 1, 1953 to Joseph B. Bear discloses a device for detecting an unsafe condition of a bridge. A horizontal arm is attached to a crank, which, when rotated, activates a visual alarm. The crank is also attached to a bridge cap so that any relative movement between the cap and the pile will activate the alarm.

U.S. Pat. No. 2,689,341 issued Sep. 14, 1954 to Albert W. Holst discloses a safety device for indicating shifting of a bridge structure. Holst uses an electrical switch comprising a pendulum bar so that if the ring and bar come into contact, indicating a shifting of the bridge, an alarm sounds after a predetermined delay.

U.S. Pat. No. 3,522,790 issued Aug. 4, 1970 to Robert J. Cambre discloses a bridge failure alarm which includes tubular units having flares mounted at the top ends of both. The tubular units are pivotally attached to the spans so as to be located in either an upright or lowered position, wherein weights located at the bottom ends of the tubular units tend to rotate the tubular units to their upright positions. When lowered, the flares on each span face one another and a string is used to attach both flares maintaining the tubular units in their lowered positions until the spans move away from each thereby pulling on the string and igniting the flares when detached from both flares allowing the tubular units to rotate to their upright positions placing the ignited flares is clear view of anyone approaching the bridge.

None of the above inventions and patents, taken either singly or in combination, is seen to describe the instant invention as claimed.

SUMMARY OF THE INVENTION

The bridge failure alarm system of the present invention is used to ward off those about to cross an unsafe bridge. The device of the present invention is designed to be used with bridges which include a plurality of spans with expansion joints located between each span. A conducting wire within a conduit runs along the sides of each span of the bridge and exits the ends of the conduit proximate the ends of the span located at each corner of the span. A pin extends out from the corners of each side of each span and receives the conducting wire exiting the conduit end located proximate the same corner. Once the conducting wire passes through the pin located at one corner of a span, the conducting wire travels across the expansion joint between that same span and an adjacent span and passes through the pin located at the corner of the adjacent span proximate the same expansion joint.

In this manner, the conducting wire travels from a first end of the bridge along one side thereof, to a second end on the same side. At the second end of the bridge, the conducting wire travels underneath the bridge from the one side thereof to the other side of the bridge, and then along the other side of the bridge from the second end thereof back to the first end. The alarm system of the present invention utilizes at least one alarm annunciator at the first end of the bridge. The alarm annunciator includes a means for detecting a break in the continuity of the conducting wire, and means for activating the alarm annunciator in response thereto.

If the width of any of the expansion joints between the spans of the bridge expands beyond a predetermined safe distance, the continuity of the wire is broken to activate the alarm annunciator. The wire located between the pins across the expansion joints is provided with a predetermined amount of slack. The amount of slack determines how far the expansion joints may widen before a slip connection located in the middle of the wire between the two pins is pulled apart, thereby breaking the continuity of the conducting wire.

Accordingly, it is a principal object of the invention to produce a warning signal in the event that a bridge is unsafe to cross.

It is another object of the invention determine the unsafe condition of a bridge whenever any one of the expansion joints between the spans of the bridge exceeds a predetermined width.

It is a further object of the invention to that one of the expansions joints of the bridge exceeds the predetermined width in a simple and sure manner.

Still another object of the invention is to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 2 is a partial cross-sectional view of a span of the bridge near a pin extending out the side thereof.

FIG. 4 is a top view of the bridge utilizing the present invention.

Similar reference characters denote corresponding features consistently throughout the attached drawings.

DETAILED DESCRIPTION OF THE PREFERRED EMBODIMENT

Figure 1:
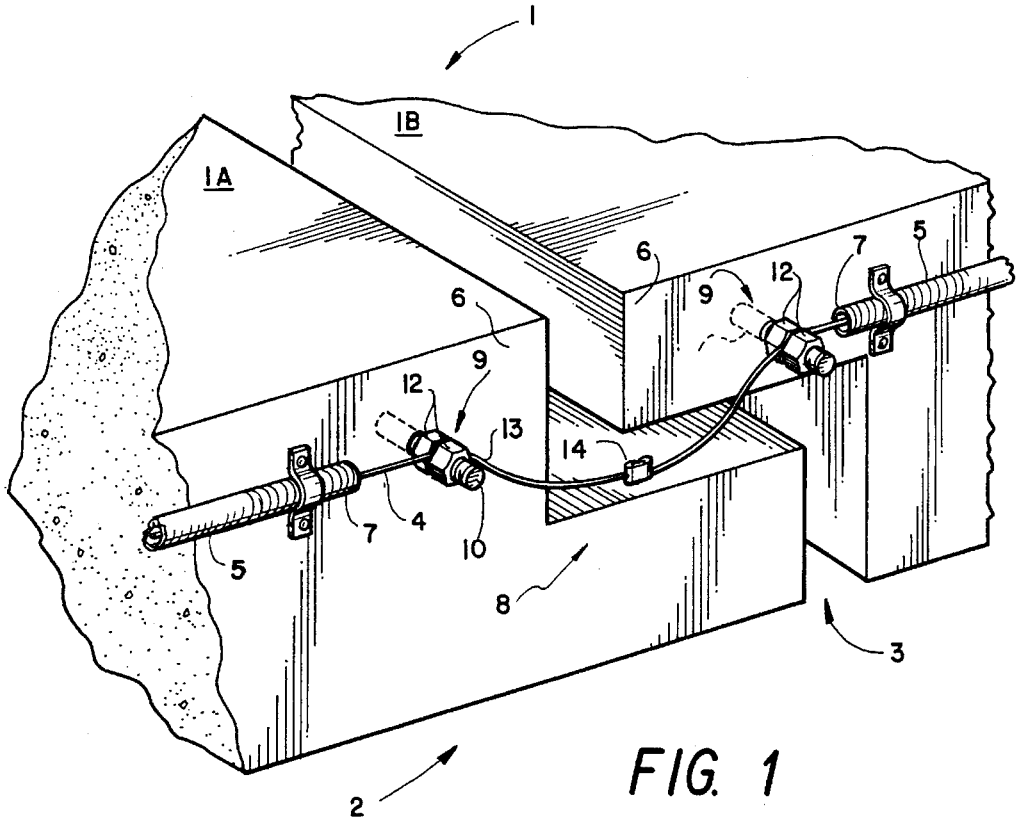
FIG. 1 is partial view of the device of the present invention located at an expansion joint between two spans of a bridge utilizing the present invention.

The bridge failure alarm of the present invention activates an alarm if any two adjacent spans of a bridge are located a distance greater than a predetermined safe distance. As illustrated in FIG. 1, a portion of the bridge 2 includes a plurality of spans 1, for example adjacent spans 1A and 1B as illustrated in FIG. 1, each of the spans 1 having expansion joints 3 located therebetween. The expansion joints 3 allow for a small amount of movement within the structure of the bridge 2 as is known in the bridge building art. Should the width across any one of the expansion joints 3 exceed a predetermined width such that the any two adjacent spans 1 exceed a safe distance from each other, the bridge 2 may not be safe to cross.

In order to determine whether or not the width of any one of the expansion joints 3 exceeds a predetermined maximum safe width, a conducting wire 4 runs along the length of the bridge 2 along both sides thereof, as will be described below. The bridge failure alarm system of the present invention includes one of the conduits 5 attached to each side of each one of the spans 1. Proximate to the corners 6 of the spans 1, the conducting wire 4 exits the ends 7 of the conduits 5 and crosses the expansion joints 3 through the use of jumper arrangements 8. In this manner, the conducting wire 4 completes a conduction path from one end of the bridge 2 to the other end. Should any of the expansion joints 3 exceed the predetermined maximum safe width, the conduction path is broken, as will be described below. The breaking of the conduction path indicates that the bridge 2 is unsafe to cross because one of the spans has been dislodged from its normal position. As long as the conduction path of the conducting wire 4 around the bridge 2 is not broken, the spans 1 of the bridge 2 are intact and the bridge 2 is safe to cross.

FIG. 1 illustrates the manner in which the jumper arrangements 8 are used to detect whether or not an expansion joint 3 exceeds its predetermined maximum safe width. The wire 4 exits the end 7 of the conduit 5 and proceeds to a pin 9 proximate the corner 6 of a span 1A. The wire 4 passes through the pin 9 at the corner 6 and then travels across the expansion joint 3 to another pin 9 located proximate the corner 6 of the adjacent span 1B. From the pin 9 of the adjacent span 1B, the conducting wire 4 reenters another conduit 5 located close to the pin 9 of the adjacent span 1B.

FIG. 2 illustrates the configuration of the pins 9. Each pin configuration 9 includes a threaded screw 10 placed within one side of a span 1 proximate the corner 6 thereof. A hole 11 extends through the threaded screw 9. The conducting wire passes through the hole 11 and between a pair of threaded nuts 12 attached to the threaded screw 10. The threaded nuts 12 clamp the conducting wire 4 located therebetween, thereby preventing the conducting wire 4 within the conduit 7 from moving laterally.

As illustrated in FIG. 1, a portion 13 of the conducting wire 4 crossing the expansion joint 3 includes a slip connector arrangement 14 allowing the conducting wire 4 to be pulled apart if the portion 13 becomes taut and begins to stretch. The pin arrangements 9 and the portion 13 of the conducting wire 4 crossing the expansion joint 3 make up the jumper arrangement 8. The portion 13 of the conducting wire 4 includes a predetermined amount of slack which is taken up when the expansion joint 3 expands to its predetermined maximum safe width. Should the expansion joint 3 exceed its maximum predetermined safe width, the conducting wire 4 is pulled apart at the slip connector arrangement 14, thereby indicating the unsafe condition of the bridge 2. The predetermined amount of slack is maintained by the pin arrangements 9 through the use of the pair of threaded nuts clamping the portion 13 of the conducting wire 4 located between the pin arrangements 9.

Figure 3:
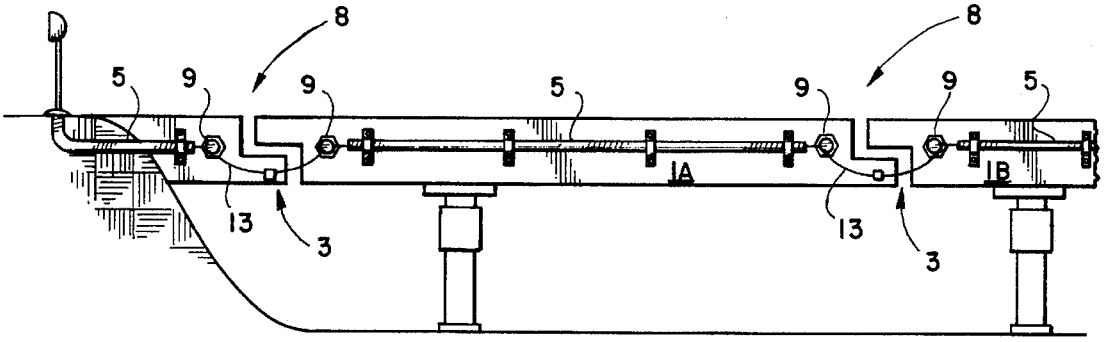
FIG. 3 is a partial side view of the bridge utilizing the present invention.

As illustrated in FIG. 3, at one end of the bridge 2, there is an alarm annunciator 15 which includes control circuitry associated therewith for activating the lamps 16 associated therewith. As shown in FIG. 4, the alarm annunciator 15 preferably includes a pair of lamps 16 for providing a visual warning indication when activated by the control circuitry.

The bridge alarm failure system 17 of the present invention is shown attached to bridge 2 for warning traffic heading in a direction 18 if either of the spans 1A and 1B become dislodged. The bridge failure alarm system 17 includes the alarm annunciator 15 located at the beginning of the bridge. The conducting wire 4 travels along both sides of the bridge 2, crossing the expansion joints 3 through the aid of the jumper arrangements 8 discussed above. At the end of the bridge 2, the conducting wire 4 crosses underneath the bridge to complete a conduction loop for the control circuitry illustrated in FIG. 5. An identical bridge failure alarm system 17 is provided on a bridge 20 handling traffic in an opposite direction 19.

Figure 5:
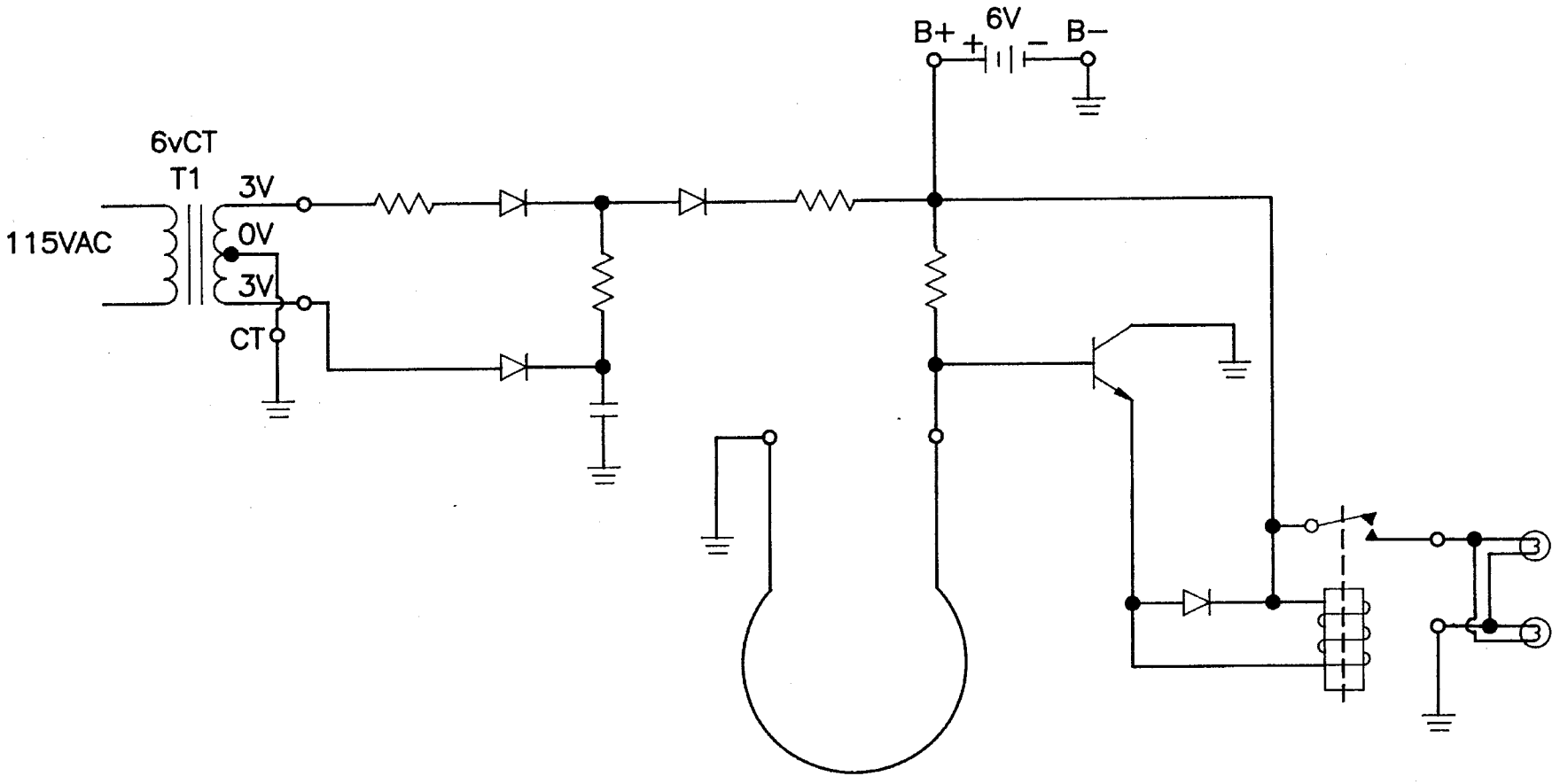
FIG. 5 is a schematic diagram of the present invention.

The control circuitry for the bridge failure alarm system 17 is illustrated in FIG. 5. Regular household current, 115 volts AC, is supplied to a step-down transformer T1. A half-wave rectifier consisting of resistors R1, R2, R3, capacitor C1, and diodes D1, D2, and D3, recharges the rechargeable battery B. The battery B allows a small amount of current to flow through the conduction path of wire 4. Resistor R4 is a current limiting resistor which limits the amount of current passing through the conduction path of conducting wire 4. Should the conduction path of wire 4 open, current passing through the conduction path of wire 4 would be redirected to the base of a relay actuator transistor Q1. This in turn provides power to the relay coil RC via a diode D4, thus activating the relay coil RC. Once the relay coil RC is activated, the normally open switch SW is closed to provide power to lamp 16 of the alarm annunciator.

The bridges 2 and 20, as illustrated in FIG. 4, are preferably part of an interstate system. The bridge failure alarm systems 17 are used to alert traffic heading in either direction 18 or direction 19 should any of the spans become dislodged to the point to where any one of the expansion joints 3 exceeds the predetermined safe width. This could be the result of an earthquake or a vehicle passing underneath the bridges 2 and 20 hitting one of the spans 1.

It is to be understood that the present invention is not limited to the sole embodiment described above, but encompasses any and all embodiments within the scope of the following claims.

We claim:

1. A bridge failure alarm system for producing an alarm signal to alert a user about to cross a bridge having a plurality of spans thereacross, that it is unsafe to cross in the event that an expansion joint space between any two adjacent spans of said bridge is greater than a predetermined safe distance, comprising:

a conduction loop including a pair of conducting wires separately running along opposite sides of each span of the bridge;

means for determining if an expansion joint space between two adjacent spans of said bridge is greater than said predetermined safe distance by breakage of at least one of the conducting wires; and means for generating said alarm signal in the event that said expansion joint space between any two adjacent spans of the bridge is greater than said predetermined safe distance as determined by said means for determining.

2. A bridge failure alarm system as claimed in claim 1, wherein each one of said plurality of spans include two corners at a front end thereof and two corners at a back end thereof with two sides, each span extending from one of the front corners to one of the back corners; and further, wherein one of said pair of conducting wires extends from one of said front corners to one of said back corners and the other one of said pair of conducting wires extends from an opposite one of said front corners to an opposite one of said back corners.

3. A bridge failure alarm system for producing an alarm signal to alert a user about to cross a bridge having a plurality of spans thereacross, that it is unsafe to cross in the event that an expansion joint space between any two adjacent spans of said bridge is greater than a predetermined safe distance, comprising:

means for determining if an expansion joint space between two adjacent spans of said bridge is greater than said predetermined safe distance;

each one of said plurality of spans includes a pair of conducting wires which separately run along opposite sides of each span;

each one of said plurality of spans includes two corners at a front end thereof and two corners at a back end thereof with two sides, each span extending from one of the front corners to one of the back corners; and further, wherein one of said pair of conducting wires extends from one of said front corners to one of said back corners and the other one of said pair of conducting wires extends from an opposite one of said front corners to an opposite one of said back corners;

a plurality of conduits having a first end and a second end, said plurality of conduits attached to both a first side of the bridge and a second side of the bridge, each span having one conduit attached thereto located on the first side of the bridge and one conduit attached thereto located on the second side of the bridge;

a conducting wire including said pairs of conducting wires extending through each conduit from the front end of the bridge along the first side thereof to the back end of the bridge along the first side thereof, and along the back end thereof from the first side thereof to the second side thereof, and from the back end of the bridge along the second side thereof back to the front end of the bridge along the second side thereof;

jumper arrangements located along both the first and second sides of the bridge proximate each expansion joint thereof for maintaining a conduction path across each expansion joint; and means for generating said alarm signal in that said expansion joint space between any two adjacent spans of the bridge is greater than said predetermined safe distance as determined by said means for determining.

4. The bridge failure alarm system for producing an alarm signal to alert a user about to cross a bridge having a plurality of spans thereacross, that it is unsafe to cross in the event that an expansion joint space between any two adjacent spans of said bridge is greater than a predetermined safe distance, comprising:

means for determining if an expansion joint space between two adjacent spans of said bridge is greater than said predetermined safe distance;

each one of said plurality of spans includes a pair of conducting wires which separately run along opposite sides of each span;

each one of said plurality of spans includes two corners at a front end thereof and two corners at a back end thereof with two sides, each span extending from one of the front corners to one of the back corners; and further, wherein one of said pair of conducting wires extends from one of said front corners to one of said back corners and the other one of said pair of conducting wires extends from an opposite one of said front corners to an opposite one of said back corners;

a plurality of conduits having a first end and a second end, said plurality of conduits attached to both a first side of the bridge and a second side of the bridge, each span having one conduit attached thereto located on the first side of the bridge and one conduit attached thereto located on the second side of the bridge;

a conducting wire including said pairs of conducting wires extending through each conduit from the front end of the bridge along the first side thereof to the back end of the bridge along the first side thereof, and along the back end thereof from the first side thereof to the second side thereof, and from the back end of the bridge along the second side thereof back to the front end of the bridge along the second side thereof;

jumper arrangements located along both the first and second sides of the bridge proximate each expansion joint thereof for maintaining a conduction path across each expansion joint;

a pair of pins extending out from said each one of said adjacent spans proximate said expansion joint in closest proximity to one jumper arrangement;

means for clamping said conducting wire to each of said pair of pins;

a slip connector arrangement located on said conducting wire between said pair of pins; and means for generating said alarm signal in the event that said expansion joint space between any two adjacent spans of the bridge is greater than said predetermined safe distance as determined by said means for determining.

* * * * *